United States Patent [19]

Tenconi

[11] Patent Number: 4,884,417

[45] Date of Patent: Dec. 5, 1989

[54] NEEDLE SELECTION DEVICE IN KNITTING, SOCK- AND STOCKING-MAKING MACHINES AND THE LIKE

[75] Inventor: Riccardo Tenconi, Varese, Italy

[73] Assignee: MEC-MOR S.P.A., Olona Va, Italy

[21] Appl. No.: 162,395

[22] Filed: Feb. 29, 1988

[30] Foreign Application Priority Data

Mar. 4, 1987 [IT] Italy ..... 19580 A/87

[51] Int. Cl.[4] ..... D04B 15/18

[52] U.S. Cl. ..... 66/220; 66/222

[58] Field of Search ..... 66/75.2, 219, 220, 222, 66/25

[56] References Cited

U.S. PATENT DOCUMENTS

| | | | |
|---|---|---|---|
| 3,449,928 | 6/1969 | Schmidt et al. | 66/219 |
| 3,817,059 | 6/1974 | Krause | 66/75.2 |
| 3,943,730 | 3/1976 | Krause | 66/70 |
| 4,688,404 | 8/1987 | Elsässer et al. | 66/219 |

FOREIGN PATENT DOCUMENTS

| | | | |
|---|---|---|---|
| 1635968 | 10/1977 | Fed. Rep. of Germany | 66/75.2 |
| 2029867 | 3/1980 | United Kingdom | 66/75.2 |
| 2099463 | 12/1982 | United Kingdom | 66/25 |

*Primary Examiner*—Wm. Carter Reynolds

*Attorney, Agent, or Firm*—Guido Modiano; Albert Josif

[57] ABSTRACT

This device for the selection of the needles comprises a selector accommodated below a needle in a same groove of a needle bed of the machine. The selector is controllably movable from an extraction position, in which a heel thereof protrudes from the groove to engage with selection cams facing said needle bed, to a sunk position, in which the heel is accommodated in the groove so as to not engage with the selection cams. Between the selector and the bottom of the groove an elastic element is interposed which keeps the selector in the extraction position and a sinking cam is provided, rigidly associated with the selection cams, which causes the passage of the selector from the extraction position to the sunk position in contrast with the elastic element. A rod is engageable with the elastic element to keep the selector in the sunk position and actuators controllably act on the rod to cause disengagement thereof from the elastic element so as to obtain the passage of the selector to the extraction position.

7 Claims, 3 Drawing Sheets

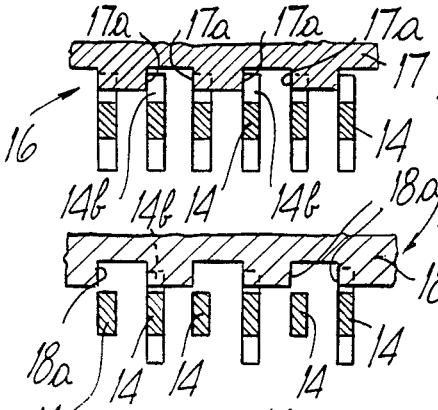
Fig. 10
Fig. 11
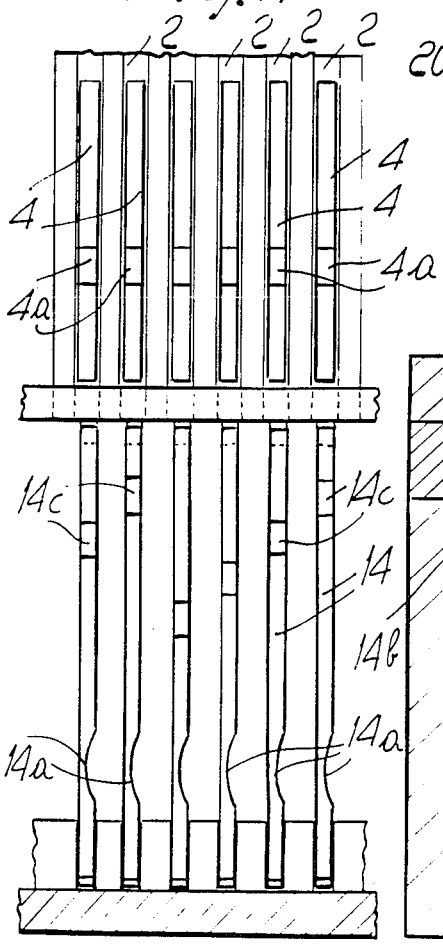
Fig. 9
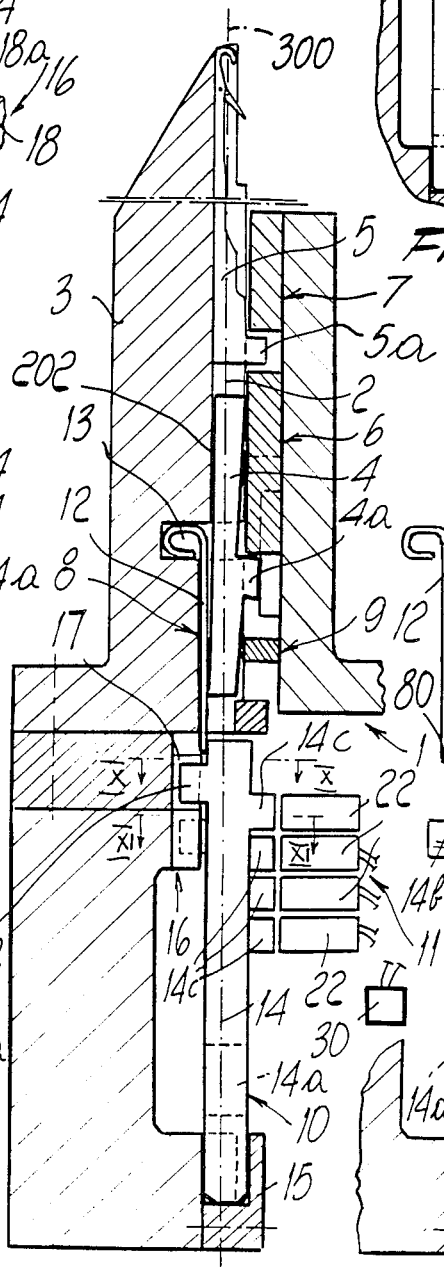
Fig. 1
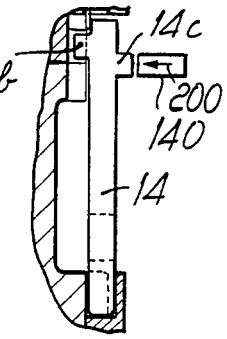
Fig. 15
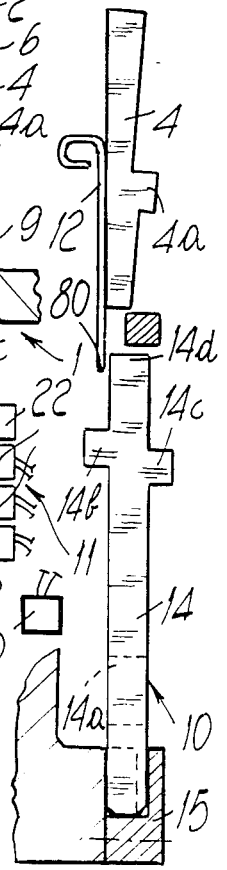
Fig. 3

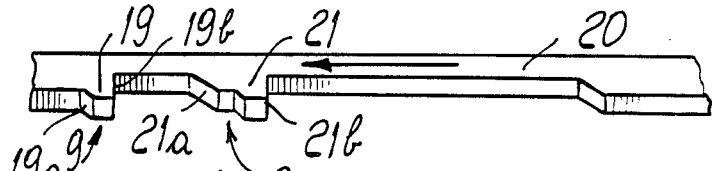
Fig. 6
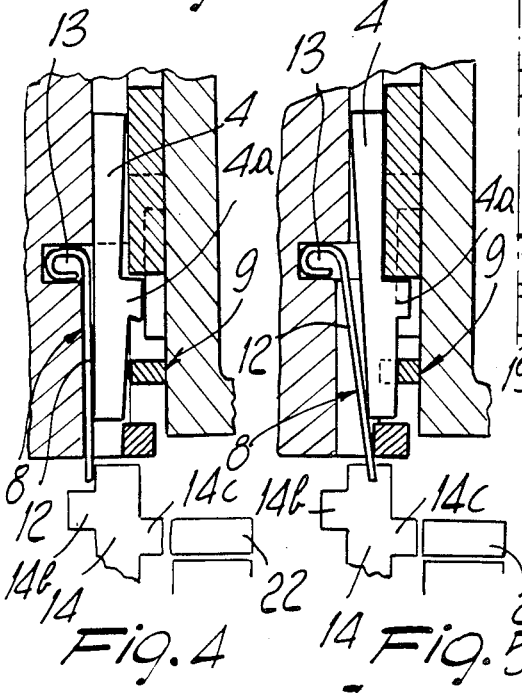
Fig. 4
Fig. 5
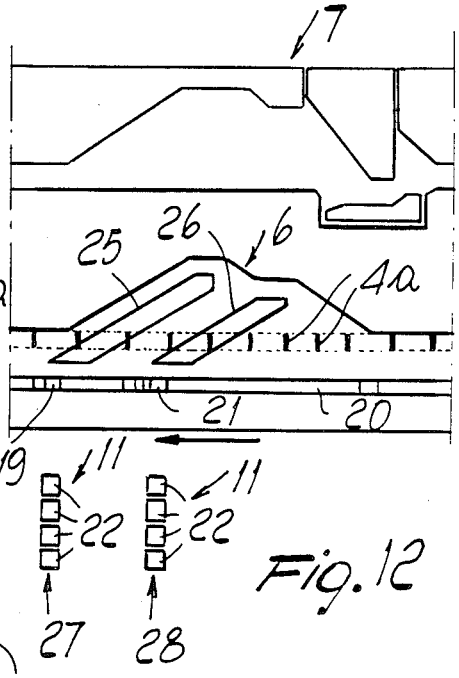
Fig. 12
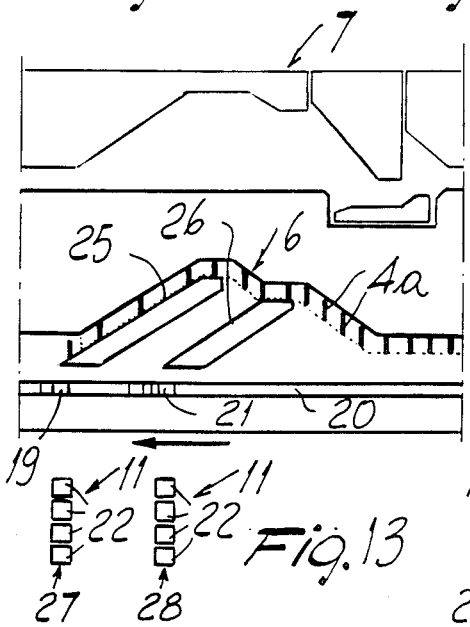
Fig. 13
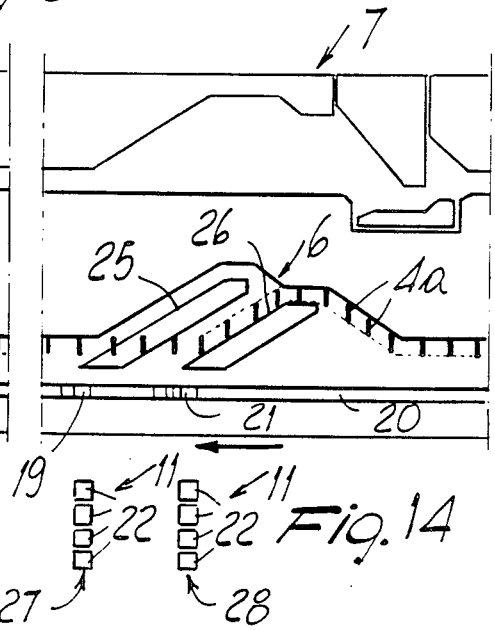
Fig. 14

NEEDLE SELECTION DEVICE IN KNITTING, SOCK- AND STOCKING-MAKING MACHINES AND THE LIKE

BACKGROUND OF THE INVENTION

The present invention relates to a needle selection device in knitting, sock- and stocking-making machines and the like.

Devices for the selection of the needles in knitting machines are known. In particular, in circular machines, said devices generally use selectors arranged below the needles in the grooves defined on the lateral surface of the needle cylinder. The selectors are provided, on their side facing towards the outside of the needle cylinder, with at least one heel and are controllably movable from an extracted position, in which said heel protrudes from the related groove to engage with selection cams arranged around the needle cylinder, to a sunk position, in which the heel of the selector is completely accommodated into the related groove so as to not engage with the selection cams. These selection cams define guide paths for the heel of the selector engaged therewith when the selection cams are caused to rotate relatively to the needle cylinder. By virtue of the movement of the selector heel along the paths of the selection cams, the selector undergoes a longitudinal shift in the related groove which causes it to push the overlying needle to selectively engage with its heel within adapted paths defined by needle cams rigid with the selection cams so as to perform the desired knitting.

If it is desired to exclude one or more needles from the knitting, it is sufficient to move or retain the related selector or selectors in the sunk position. As is apparent, the choice of the needles to be operated is determined by the choice of the selectors which are brought or kept in the extraction position. To effect this choice, each selector is provided, on the side facing towards the outside of the needle cylinder, with a plurality of heels which are engaged or not by adapted levers or blades to push them in the sunk position or keep them in the extraction position.

Selection devices are known which use a stack of levers, superimposed and oscillable by means of electromagnetic actuators from an operative position, in which one of their ends is placed at the level of one of the heels of the selector to push it in sunk position, to an inoperative position, in which the end of the lever is in an intermediate position between the heels of the selectors so as to not interfere therewith and therefore keep the selectors in extraction position.

Mechanical devices are also known, termed drawing drums, which provide the same conditions by moving, by means of pins protruding according to a preset arrangement on a rotating cylinder, the levers towards or away from the axis of the needle cylinder.

Similar selection devices are also used for the selection of the dial needles in circular knitting machines of the type with cylinder and dial.

In order to obtain an accurate selection, or to actuate a restricted number of selectors differently from the contiguous selectors, it is necessary to provide selectors with a high number of heels, therefore a high number of levers. This fact in turn entails the problem of arranging a high number of electromagnetic actuators or of equivalent devices proximate to the needle cylinder.

Since the selection must be effected in a restricted region, it is necessary to reconcile the opposite requirements of reduced dimensions and of high number of selection actuators to achieve an individual selection of the needles.

Another problem found in known selection devices is that of the wear due to the high number of actuation cycles of said devices caused by the high number of elements in mutual contact.

SUMMARY OF THE INVENTION

The aim of the present invention is to solve the above described problems by providing a device which allows an individual selection of the needles using a reduced number of components, is simple to manufacture and has a modest cost.

Within this aim, an object of the invention is to provide a device which is simple to actuate and control so as to be operable by an electronic control element with a very simple and reliable program.

This aim, as well as this and other objects which will become apparent hereinafter, are achieved by a needle selection device in knitting sock- and stocking-making machines and the like, as defined in the appended claims.

BRIEF DESCRIPTION OF THE DRAWINGS

The characteristics and advantages of the invention will become apparent from the description of a preferred, but not exclusive, embodiment of the device for the selection of the needles according to the invention applied to a circular knitting machine, illustrated only by way of non-limitative example in the accompanying drawings, wherein:

FIG. 1 is a sectional view taken along a radial plane of the needle cylinder of a circular knitting machine pointing out the device according to the invention with the selector in sunk position;

FIG. 2 is a sectional view similar to that of FIG. 1 with the selector in extraction position;

FIG. 3 is an exploded detail view of FIG. 1;

FIGS. 4 and 5 are detail views respectively of FIG. 1 and of FIG. 2;

FIG. 6 is a perspective view of a portion of the machine with the sinking cam according the the invention;

FIG. 7 is a perspective view of the engagement means and of the elastic element according to the invention;

FIGS. 8 and 9 are lateral elevation views of a portion of the needle cylinder;

FIG. 10 is a sectional view of FIG. 1 taken along the axis X—X;

FIG. 11 is a sectional view of FIG. 1 taken along the axis XI—XI;

FIGS. 12 to 14 are schematic views of the inner side of a portion of the outer surface of the cams of a circular knitting machine developed on a plane and pointing out the operation of the device according to the invention; and FIG. 15 is a schematic sectional view showing a varied embodiment of the actuator means.

DESCRIPTION OF THE PREFERRED EMBODIMENTS

Figures 2, 8:
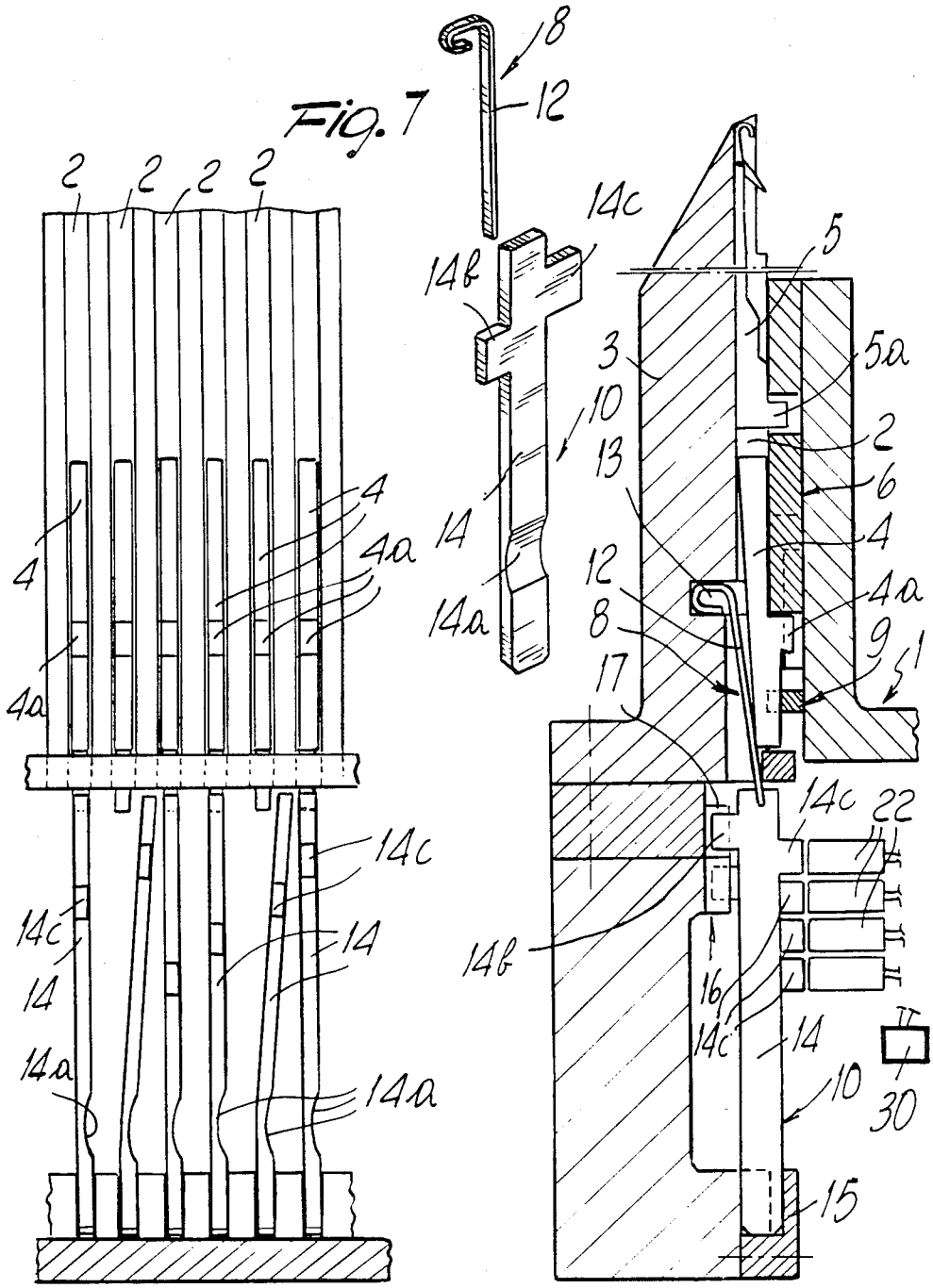

With reference to the above figures, the device for the selection of the needles according to the invention, generally indicated by the reference numeral 1, comprises, for each of the grooves 2, which are defined in the needle bed of a knitting machine or, as in this case, extend on the lateral outer surface of the needle cylinder 3 parallel to its axis, a selector 4 arranged below each needle 5 accommodated in the same groove so as to be slideable in a longitudinal direction, or along a direction which is parallel to the axis of the needle cylinder 3, usually arranged vertically. The selector 4 and the needle 5 are retained by adherence in the related groove 2 by means of their known configuration.

The selector 4 is provided, on its side facing away from the bottom of the groove, with at least one heel 4*a* which is engageable with selection cams 6 which are arranged around the needle cylinder, or are facing the needle bed of the machine, and which define paths for the heel so that, by rotating the selection cams about the axis of the needle cylinder relatively thereto, the selector is moved along the related groove 2 to act on the overlying needle. The needle 5 is in turn provided, on its side facing towards the outside of the needle cylinder, with a heel 5*a* which is engageable with the needle cams 7 which are also arranged around the needle cylinder and are rigid with the selection cams.

The needle cams 7 also define paths which are selectively followed by the heel 5*a* when the needle cams rotate relatively to the needle cylinder. These paths reciprocately actuate the needles along the related grooves to move them for taking the thread at the various feeds or drops of the machines and to form knitting.

Naturally, in order to obtain this, it is possible to rotate the cams with respect to the needle cylinder, the latter being kept fixed, or it is possible to rotate the needle cylinder with respect to the cams, these last being kept fixed.

The passage of the heel 5*a* of the needle from one path to the other of the needle cams is determined by raising or not the related selector, which in turn can change the path followed by its heel, being controllably movable from an extraction position, in which its heel protrudes from the related groove to engage with the related selection cams, to a sunk position, wherein its heel is fully sunk in the related groove so as to not engage with the selection cams.

According to the invention, the selection device comprises, for each selector: an elastic element 8, which acts on the related selector for its retention in the extraction position, a sinking cam 9 which acts on the selector to push it in the sunk position against the elastic element 8 and engagement means 10 which are engageable with the elastic element 8 when the selector is in sunk position to keep the selector in said position. The device according to the invention also comprises actuator means 11 which are arranged after the sinking cam 9, according to the direction of rotation of the selection cams, and which act on the engagement means 10 for their disengagement from the elastic element 8.

More particularly, the elastic element 8 is constituted by a small spring 12 interposed between the bottom of the groove 2 and the selector 4. Said spring 12 has one of its ends folded and inserted in an adapted recess 13 defined on the bottom of the groove and the other end extending downwardly beyond the lower end of the selector 4, to a position behind the upper end 14*d* of the rod 14, such that the lower end portion 80 of the elastic element 8 is latched behind the upper end 14*d* of the rod 14, as clearly shown in FIGS. 1 and 3.

The engagement means 10 comprise, for each selector 4, a rod 14 which is arranged aligned with a groove 2 below the selector 4 and has its lower end rigid with a support 15 fixed to the needle cylinder and its upper end movable, in a plane 300 extending parallel to the bottom 202 of the groove 2 (see FIG. 1), from an operative position, in which it engages with the lower end of the small spring 12, to an inoperative position, in which it does not interfere with the spring 12. In the illustrated embodiment, the rod 14 is elastically flexible in a plane tangent to the needle cylinder for allowing passage of its upper end from the operative position to the inoperative position and vice versa. To facilitate this flexing, the rod 14 has, in one of its portions, a thickness reduction 14*a*.

Advantageously, means 16 for delimiting the flexing of the rod 14 are provided, constituted by abutments 17*a* defined on a ring 17 fixed around the needle cylinder. More particularly, since for each groove 2 a rod 14 is provided, each rod 14 has, on its side facing the needle cylinder, an expansion 14*b* which can move, due to the flexing of the rod 14, within a seat defined between two successive abutments 17*a* (FIG. 10). Advantageously, to avoid interferences between two contiguous rods 14, the expansions 14*b* of two contiguous rods may be placed at mutually different levels and two rings 17 and 18, with respective abutments 17*a* and 18*a*, may be provided substantially identical to one another but angularly offset by an angle equal to the spacing angle between two successive grooves of the needle cyliner.

The sinking cam 9 can be constituted simply by at least one raised portion 19 carried by an annular band 20 rigid with the selection cams. In the embodiment illustrated in particular in FIG. 6, two raised portions 19 and 21 are visible which have portions 19*a* and 21*a* which extends towards the axis of the needle cylinder and portions 19*b* and 21*b* which extend away from the axis of the needle cylinder, considering a direction of rotation of the cams as indicated by the arrow on the annular band 20.

The actuator means 11, indicated only schematically in the figures, are rigid with the outer surface of the cams, therefore they are rigid with the selection cams, and can be constituted by electromagnets 22 facing the needle cylinder at a protrusion 14*c* of the rod 14 directed towards the outside of the needle cylinder.

By activating an electromagnet 22, during the rotation of the surface of the cams, it is possible to obtain flexing of the rod 14 and its passage from the operative position to the inoperative position.

To allow a wide possibility of selection without creating actuation interferences between two contiguous rods, a plurality of electromagnets 22 may be provided, arranged at different height levels, providing that the protrusions 14*c* of contiguous rods 14 also be arranged at mutually different levels.

The actuator means could, however, also be constituted by conventional mechanical devices which controllably contact a rod 14 after the intervention of the sinking cam 9 or by nozzles which controllably deliver a pressurized fluid which strikes the rod 14 causing its flexing. Or again, the actuator means may be constituted by permanent magnets which are controllably moved closer to the rod 14 to cause its flexing. Movement of a permanent magnet towards and away form the rod 14 may be effected by any conventional means commonly employed in the field of mechanics for causing such kind of movement. In the case of the use of electromagnets, permanent magnets, or pressurized-fluid delivery nozzles, it will be apparent that the flexing of the rod 14 can be achieved without direct contact with the rod. For example, FIG. 15 schematically illustrates an electromagnet 140 moved towards the rod 14 in the direction of the arrow 200 for causing flexing of the rod 14, but without making physical contact therewith.

The operation of the device according to the invention is explained with particular reference to FIGS. 12, 13 and 14, which illustrate, by way of example, selection cams which define a first rising portion 25 and a second rising portion 26 arranged in succession according to the direction of motion of the selection cams relatively to the needle cylinder indicated by an arrow in said figures.

The actuator means 11 are divided in a first group 27 and in a second group 28 arranged at the beginning of said rising portions 25,26 and immediately after the raised portions 19 and 21 of sinking cams 9.

In case the selection cams 6 should not engage specific selectors 4, it is sufficient not to activate the actuator means 11 intended to act on the corresponding rods 14. In this manner, supposing the selectors 4 are in the extraction position, when the raised portion 19 intervenes on these selectors, the latter are moved to the sunk position and the elastic element 8 is engaged by the rod 14. Thus, as long as the actuator means 11 do not intervene, the selector 4 remains in the sunk position and does not engage the selection cams. In this case the needles 5 which are arranged above said selectors do not perform any knitting or, at least, their heel 5*a* does not have the possibility of changing path (FIG. 12).

If instead the heel 4*a* of the one or more selectors is to be engaged with the first rising portion 25 of the selection cams 6, after the rod 14 has engaged the elastic element 8 by the action of the raised portion 19, one or more of the actuator means 11 of the first group 27, arranged at the beginning of the first rising portion 25, is activated and causes flexing of the rod 14. The effect of this flexing is that of obtaining the disengagement of the elastic element which thus moves the selector 4 in operative position with the consequent engagement of its heel with the first rising portion 25. Rising of the selector 4 causes the passage of the heel 5*a* of the needle from one path to another path in the needle cams, according to the various processing requirements. In this case, the raised portion 21 does not intervene on the selectors which are engaged with the first raised portion 25 since said selectors are in a raised position with respect to the sinking cam (FIG. 13).

If the heel 4*a* of one or more selectors 4 is to be engaged with the second rising portion 26 of the selection cams 6, none of the actuator means of the first group 27 is activated for this selector, but one or more of the actuator means of the second group 28 arranged at the beginning of the second rising portion 26 is activated. The operation of the actuator means causes the disengagement of the elastic element 8 with the consequent engagement of the heel 4*a* of the selector 4 with the second rising portion 26. Also in this case the rise of the selector or selectors causes the change of the path of the heel of the overlying needles (FIG. 14).

The actuator means 11 can be actuated by a control element 30, for example of the electronic type, which supervises the various operations of the machine.

In practice it has been observed that the device according to the invention fully achieves the intended aim, since with a reduced number of actuator means it is able to obtain an individual selection of the needles.

Moreover, since it is possible to perform the selection without direct contact between the engagement means and the actuator means, the possibility of wear of said means is excluded.

Another advantage resides in the greater simplicity in manufacture of the selectors with respect to known selectors provided with a plurality of heels.

The device according to the invention has been described in its application to the needle cylinder of a circular knitting machine, but it may also be applied to the dial of a cylinder and dial circular machine, taking into account the fact that the mentioned grooves, selectors, and therefore rods will be arranged radially.

Furthermore, the device according to the invention, though it has been studied in particular for circular machines, can be used successfully even on rectilinear machines. In this case the grooves are defined substantially in a plane, instead of on the lateral surface of a cylinder, and the needle cams with the selection cams move substantially parallel to said plane with a relative motion with respect to the needle bed. Again in this case, the rods 14 are laterally flexible in a plane which is parallel to the bottom of the grooves.

The device for the selection of the needles thus conceived is susceptible to numerous modifications and variations, all of which are within the scope of the inventive concept; moreover, all the details may be replaced with technically equivalent elements.

In practice, the materials employed, as well as the dimensions, may be any according to the requirements and to the state of the art.

I claim:

1. In a knitting machine comprising a machine needle bed having at least one groove defining a groove bottom, a needle selection device comprising: at least one selector accommodated in said groove and acting on a needle accommodated in said groove above said selector, said selector having, on a side thereof facing away from said groove bottom, at least one heel engageable with selection cams facing said needle bed and defining at least two paths which can be selectively followed by said heel during a movement of said selection cams relatively to said needle bed, said selector being controllably moveable from an extraction position, in which said heel protrudes from said groove to engage with said selection cams, to a sunk position, in which said heel is completely accommodated in said groove so as to not interfere with said selection cams; an elastic element accommodated in said groove and acting on said selector for holding said selector in said extraction position; at least one sinking cam rigid with said selection cams and acting on said selector to push said selector in said sunk position; engagement means supported by said needle bed and engageable with said elastic element with said selector in a sunk position for holding said selector in said sunk position; actuator means rigid with said selection cams, said actuator means being controllably activatable for disengaging said engagement means from said elastic element and allowing said selector to return into said extraction position, wherein said needle bed defines a needle cylinder, and wherein said engagement means comprises a rod, said rod being controlled by said actuator means for elastically flexing in a plane substantially tangent to the needle cylinder thereby moving an upper end of said rod from an operative position in engagement with said elastic element to an inoperative position away from said elastic element.

2. In a circular knitting machine according to claim 1, a device further comprising means for delimiting flexing of said rod including abutments defined on a ring rigid with the needle cylinder, said ring defining at least one stop contactable by said rod in said operative position.

3. In a circular knitting machine according to claim 1, a device wherein said actuator means comprises permanent magnets movable towards and away from said needle bed to cause flexing of said rod in said plane substantially parallel to said groove bottom.

4. In a knitting machine comprising a machine needle bed having at least one groove defining a groove bottom, a needle selection device comprising: at least one selector accommodated in said groove and acting on a needle accommodated in said groove above said selector, said selector having, on a side thereof facing away from said groove bottom, at least one heel engageable with selection cams facing said needle bed and defining at least two paths which can be selectively followed by said heel during a movement of said selection cams relatively to said needle bed, said selector being controllably movable from an extraction position, in which said heel protrudes from said groove to engage with said selection cams, to a sunk position, in which said heel is completely accommodated in said groove so as to not interfere with said selection cams; an elastic element accommodated in said groove and acting on said selector for holding said selector in said extraction position; at least on sinking cam rigid with said selection cams and acting on said selector to push said selector in said sunk position; engagement means supported by said needle bed and engageable with said elastic element with said selector in sunk position for holding said selector in said sunk position; actuator means rigid with said selection cams, said actuator means being controllably activatable for disengaging said engagement means from said elastic element and allowing said selector to return into said extraction position, wherein said engagement means comprises a rod, said rod being arranged aligned with said groove and having a lower end rigid with said needle bed, said rod being controlled by said actuator means for elastically flexing in a plane substantially parallel to said groove bottom and thereby moving an upper end of said rod from an operative position in engagement with said elastic element to an inoperative position away from said elastic element.

5. In a circular knitting machine according to claim 4 a device wherein said actuator means comprises permanent magnets movable towards and away from said needle bed to cause flexing of said rod in said plane substantially parallel to said groove bottom.

6. In a knitting machine comprising a machine needle bed defining a needle bed extension and having at least one groove arranged transverse to said needle bed extension and defining a longitudinal extension and a groove bottom, a needle selection device comprising:

at least one selector accommodated in said groove and acting on a needle accommodated in said groove above said selector, said selector having, on a side thereof facing away from said groove bottom, at lest one heel engageable with selection cams facing said needle bed and defining at least two paths which can be selectively followed by said heel during a movement of said selection cams relatively to said needle bed, said selector being controllably movable from an extraction position, in which said heel protrudes from said groove to engage with said selection cams, to a sunk position, in which said heel is completely accommodated in said groove so as to not interfere with said selection cams; an elastic element accommodated in said groove and acting on said selector for holding said selector in said extraction position; at least one sinking cam rigid with said selection cams and acting on said selector to push said selector in said sunk position; engagement means supported by said needle bed and engageable with said elastic element with said selector in said sunk position for holding said selector in said sunk position; actuator means rigid with said selection cams, said actuator means being controllably activatable for disengaging said engagement means from said elastic element and allowing said selector to return into said extraction position, wherein said engagement means comprises a rod, said rod being arranged aligned with said groove and having a lower end rigidly associated with said needle bed, said rod being controlled by said actuator means for elastically flexing in a plane substantially parallel to said groove bottom and thereby moving said upper end of said rod in a direction substantially transverse to said longitudinal extension of said groove and substantially parallel to said groove bottom, from an operative position in engagement with said elastic element to an inoperative position away from said elastic element.

7. In a circular knitting machine according to claim 6, a device wherein said actuator means comprises permanent magnets movable towards and away from said needle bed to cause flexing of said rod in said plane substantially parallel to said groove bottom.

* * * * *